US010316858B2

(12) United States Patent
Cho et al.

(10) Patent No.: US 10,316,858 B2
(45) Date of Patent: Jun. 11, 2019

(54) COMPRESSING APPARATUS HOUSING AND COMPRESSING APPARATUS

(71) Applicant: HANWHA TECHWIN CO.,LTD., Changwon-si (KR)

(72) Inventors: Jongjae Cho, Changwon-si (KR); Yeonhwa Cho, Changwon-si (KR); Bonggun Shin, Changwon-si (KR); Kangsoo Im, Changwon-si (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 622 days.

(21) Appl. No.: 14/711,919

(22) Filed: May 14, 2015

(65) Prior Publication Data

US 2016/0160876 A1 Jun. 9, 2016

(30) Foreign Application Priority Data

Dec. 4, 2014 (KR) ..... 10-2014-0173251

(51) Int. Cl.
*F04D 29/42* (2006.01)
*F04D 25/16* (2006.01)

(52) U.S. Cl.
CPC ..... *F04D 29/4206* (2013.01); *F04D 25/163* (2013.01); *F04D 29/4233* (2013.01)

(58) Field of Classification Search
CPC .. F04D 29/4206; F04D 29/4233; F01D 25/24; F01D 25/243
USPC ..... 415/214.1
See application file for complete search history.

(56) References Cited

U.S. PATENT DOCUMENTS

| | | | | |
|---|---|---|---|---|
| 4,900,225 | A | 2/1990 | Wulf et al. | |
| 6,193,463 | B1 | 2/2001 | Adeff et al. | |
| 7,610,762 | B2 * | 11/2009 | Ribaud | F01D 13/00 60/39.17 |
| 7,862,298 | B2 | 1/2011 | Cvjeticanin et al. | |
| 7,942,628 | B2 * | 5/2011 | Takahashi | F04D 17/12 415/100 |
| 8,272,832 | B2 | 9/2012 | Yin | |
| 8,419,359 | B2 | 4/2013 | Cvjeticanin et al. | |
| 9,745,986 | B2 | 8/2017 | Shin et al. | |

(Continued)

FOREIGN PATENT DOCUMENTS

| | | | |
|---|---|---|---|
| CN | 1359452 | A | 7/2002 |
| CN | 100554700 | C | 10/2009 |
| CN | 101560987 | A | 10/2009 |

(Continued)

OTHER PUBLICATIONS

Communication dated Oct. 29, 2018, issued by the State Intellectual Property Office of the People's Republic of China in counterpart Chinese Patent Application No. 201510738748.6.

*Primary Examiner* — Richard A Edgar
*Assistant Examiner* — Michael L Sehn
(74) *Attorney, Agent, or Firm* — Sughrue Mion, PLLC

(57) ABSTRACT

There is provided a compressing apparatus housing including: an inner housing unit configured to house at least a portion of an impeller unit; an outer housing unit including an inner housing receiving unit configured to receive at least a portion of the inner housing unit; and an intermediate housing unit provided between the inner housing unit and the outer housing unit and configured to form a flow path together with at least one of the inner housing unit and the outer housing unit.

17 Claims, 7 Drawing Sheets

(56) References Cited

U.S. PATENT DOCUMENTS

| | | | |
|---|---|---|---|
| 2010/0232955 | A1 | 9/2010 | Schick et al. |
| 2013/0039750 | A1 | 2/2013 | Osuka et al. |

FOREIGN PATENT DOCUMENTS

| | | | |
|---|---|---|---|
| CN | 101896726 | A | 11/2010 |
| CN | 103967811 | A | 8/2014 |
| KR | 1991-0017085 | A | 11/1991 |

* cited by examiner

COMPRESSING APPARATUS HOUSING AND COMPRESSING APPARATUS

CROSS REFERENCE TO RELATED APPLICATION

This application claims priority from Korean Patent Application No. 10-2014-0173251, filed on Dec. 4, 2014, in the Korean Intellectual Property Office, the disclosure of which is incorporated herein by reference in its entirety.

BACKGROUND

1. Field

Apparatuses consistent with exemplary embodiments relate to compressing apparatus housings and compressing apparatuses.

2. Description of the Related Art

Compressors for compressing fluids such as air, gas, and steam are used in various fields, and there are various types of compressors.

In the related art, compressors may be classified into displacement-type compressors and turbo-type compressors. In detail, compressors may be classified into one of a reciprocating compressor, a rotary screw compressor, a turbo compressor, a diaphragm compressor, and a rotary sliding vane compressor.

Such compressors may be independently used as a stand-alone, but according to the design intent, a plurality of compressors may be arranged to construct a multistage compressing apparatus. When a plurality of compressors are combined or arranged to construct a multistage compressing apparatus, a higher compression ratio may be implemented.

Meanwhile, Korean Patent Publication No. 1997-0021766 discloses a turbo compressor in which a gearbox and scrolls are separately manufactured, where the gearbox houses a gear train, and the scroll houses an impeller.

SUMMARY

One or more exemplary embodiments include compressing apparatus housings and compressing apparatuses, which make it possible to easily implement the shape of a flow path unit and reduce manufacturing costs thereof.

Additional aspects will be set forth in part in the description which follows and, in part, will be apparent from the description, or may be learned by practice of the presented exemplary embodiments.

According to an aspect of an exemplary embodiment, there is provided a compressing apparatus housing including: an inner housing unit configured to house at least a portion of an impeller unit; an outer housing unit including an inner housing receiving unit configured to receive at least a portion of the inner housing unit; and an intermediate housing unit provided between the inner housing unit and the outer housing unit and configured to form a flow path together with at least one of the inner housing unit and the outer housing unit.

The inner housing unit may include a flange unit configured to be attached to the outer housing unit.

The flange unit may include a seal installation groove provided at a portion thereof facing the outer housing unit.

The inner housing unit may include an inner housing flow path groove formed to form the flow path.

The outer housing unit may include an outer housing flow path groove formed to form the flow path unit.

The outer housing unit may include an upper outer housing and a lower outer housing connected to the upper outer housing.

The intermediate housing unit may have a hollow cylindrical shape.

The intermediate housing unit may include a fluid guide unit configured to guide a fluid flowing through the flow path unit.

The intermediate housing unit may include a flow hole configured to connect the flow path from a first side of the intermediate housing unit to a second side of the intermediate housing unit opposite to the first side.

The flow path may be formed only on an inner side of the intermediate housing unit with respect to a radial direction of the compressing apparatus housing.

According to an aspect of another exemplary embodiment, there is provided a compressing apparatus including: at least one impeller unit; an inner housing unit configured to house at least a portion of the at least one impeller unit; an outer housing unit including an inner housing receiving unit configured to house at least a portion of the inner housing unit; and an intermediate housing unit provided between the inner housing unit and the outer housing unit and configured to form a flow path together with at least one of the inner housing unit and the outer housing unit.

The inner housing unit may include a flange unit configured to be attached to the outer housing unit.

The flange unit may include a seal installation groove provided at a portion thereof facing the outer housing unit.

The inner housing unit may include an inner housing flow path groove formed to form the flow path.

The outer housing unit may include an outer housing flow path groove formed to form the flow path unit.

The outer housing unit may include an upper outer housing and a lower outer housing connected to the upper outer housing.

The intermediate housing unit may have a hollow cylindrical shape.

The intermediate housing unit may include a fluid guide unit configured to guide a fluid flowing through the flow path unit.

The intermediate housing unit may include a flow hole configured to connect the flow path from a first side of the intermediate housing unit to a second side of the intermediate housing unit opposite to the first side.

The compressing apparatus may further include a driving gear train configured to drive the impeller unit, wherein the outer housing unit may further include a gear train receiving unit configured to house the driving gear train.

BRIEF DESCRIPTION OF THE DRAWINGS

The above and/or other aspects will become apparent and more readily appreciated from the following description of exemplary embodiments, taken in conjunction with the accompanying drawings in which.

DETAILED DESCRIPTION

Figure 1:
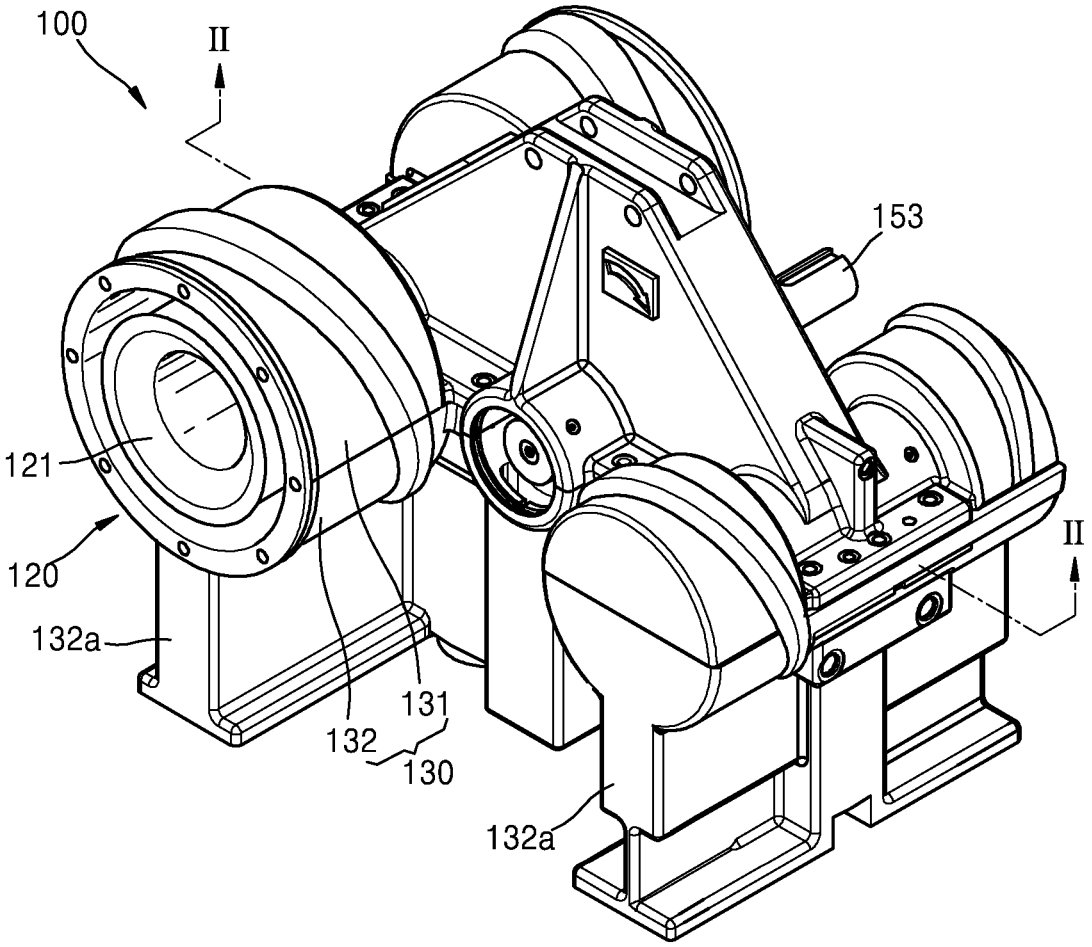
FIG. 1 is a schematic perspective view of a compressing apparatus according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, expressions such as "at least one of," when preceding a list of elements, modify the entire list of elements and do not modify the individual elements of the list.

Hereinafter, exemplary embodiments will be described in detail with reference to the accompanying drawings. Also, in the specification and the drawings, like reference numerals denote like elements, and redundant descriptions thereof will be omitted.

Figure 2:
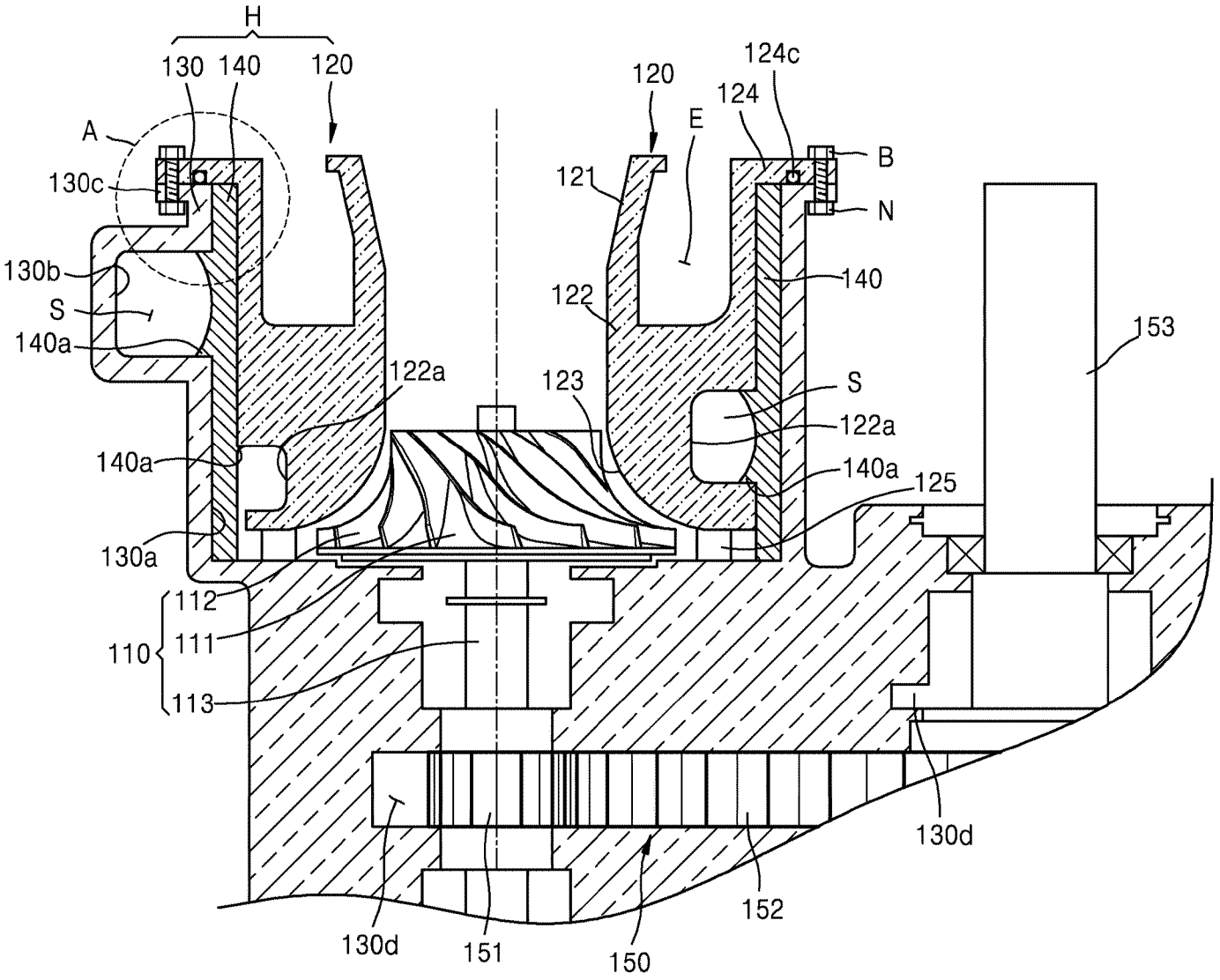
FIG. 2 is a cross-sectional view taken along a line II-II of FIG. 1 to show an internal structure of the compressing apparatus according to an exemplary embodiment.
Figure 3:
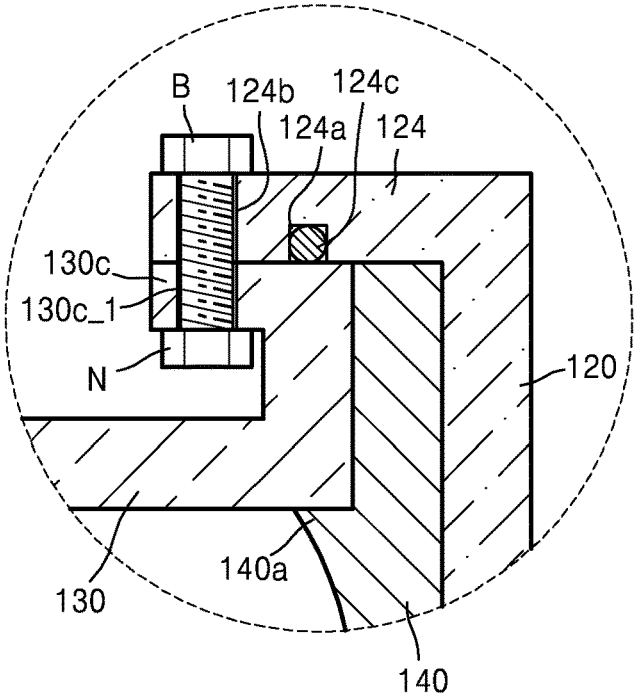
FIG. 3 is a schematic enlarged view of a portion A illustrated in FIG. 2.
Figure 4:
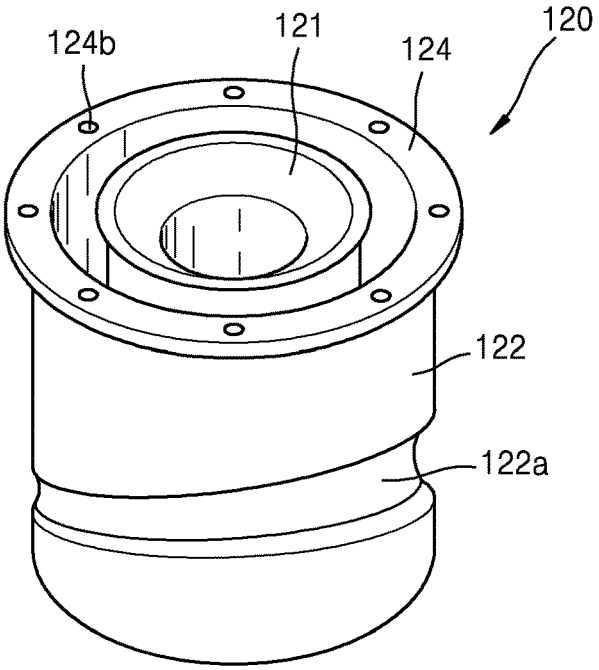
FIG. 4 is a schematic perspective view of an inner housing unit according to an exemplary embodiment.
Figure 5:
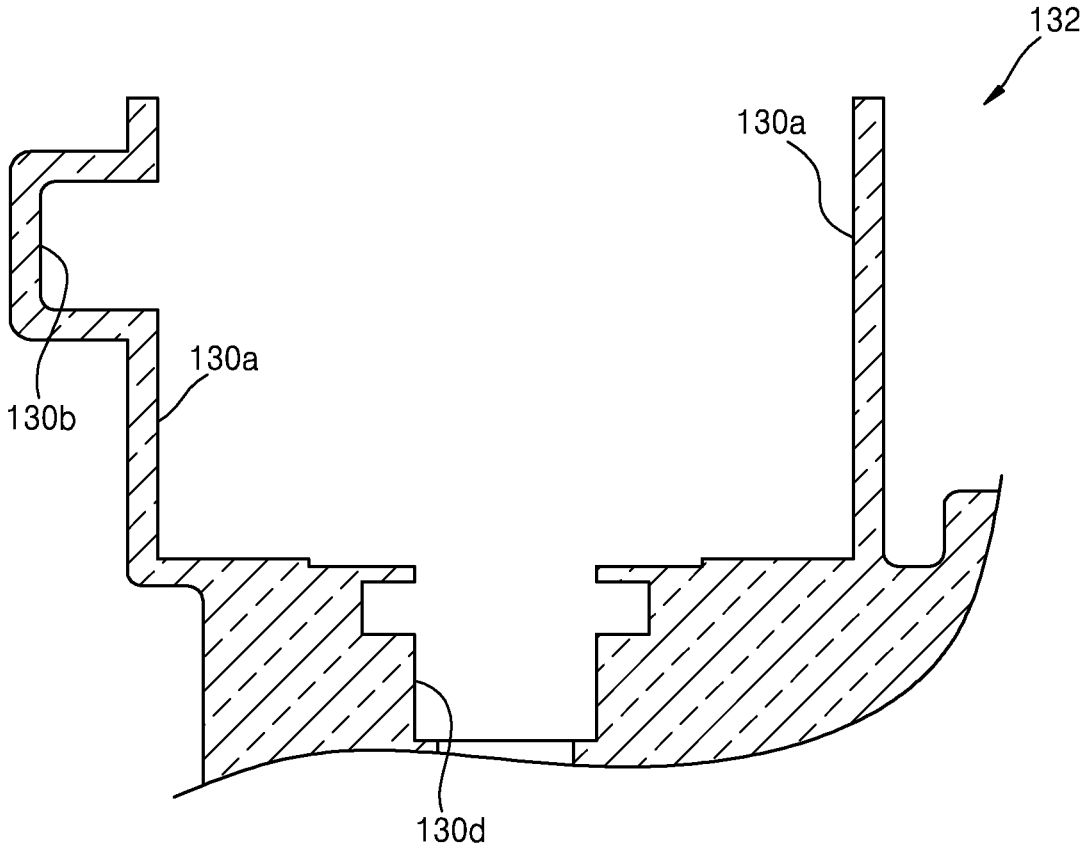
FIG. 5 is a schematic partial plan view of a lower outer housing according to an exemplary embodiment.
Figure 6:
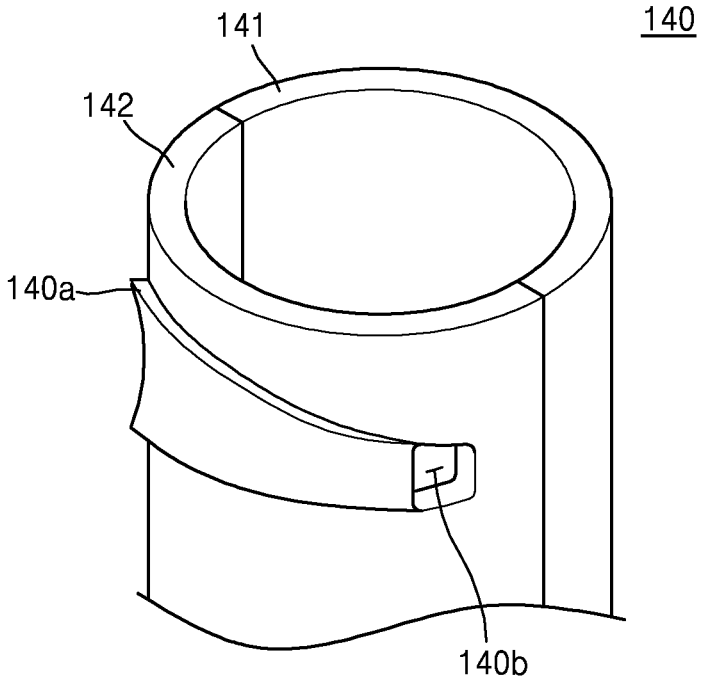
FIG. 6 is a schematic perspective view of an intermediate housing unit according to an exemplary embodiment.
Figure 7:
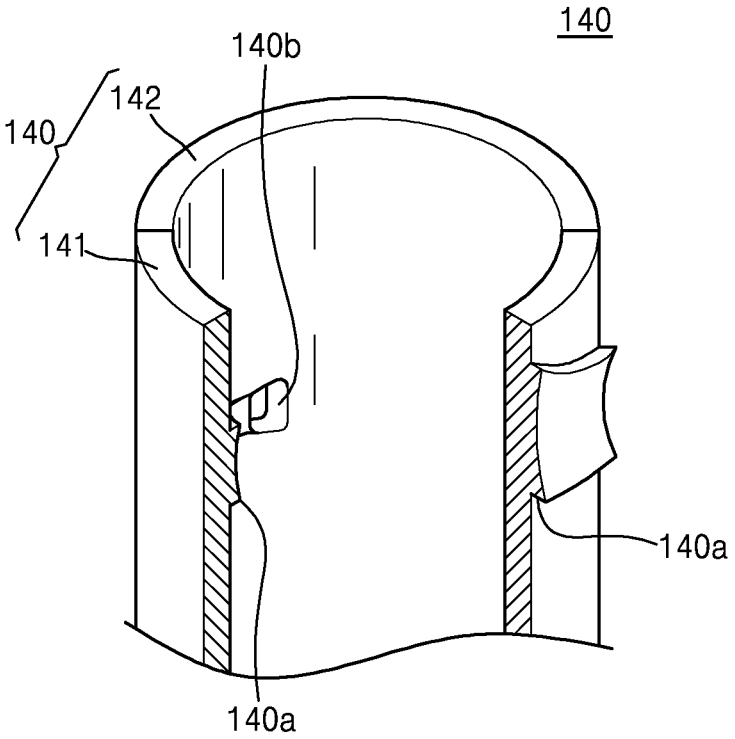
FIG. 7 is a schematic cutaway view of the intermediate housing unit of FIG. 6, which shows an inside surface of the intermediate housing unit.

FIG. 1 is a schematic perspective view of a compressing apparatus 100 according to an exemplary embodiment. FIG. 2 is a cross-sectional view taken along a line II-II of FIG. 1 to show an internal structure of the compressing apparatus 100 according to an exemplary embodiment. FIG. 3 is a schematic enlarged view of a portion A illustrated in FIG. 2. FIG. 4 is a schematic perspective view of an inner housing unit 120 according to an exemplary embodiment. FIG. 5 is a schematic partial plan view of a lower outer housing 132 according to an exemplary embodiment. FIG. 6 is a schematic perspective view of an intermediate housing unit 140 according to an exemplary embodiment. FIG. 7 is a schematic cutaway view of the intermediate housing unit 140 of FIG. 6, which shows an inside surface of the intermediate housing unit 140.

As illustrated in FIGS. 1 to 7, the compressing apparatus 100 performs multistage compression and includes an impeller unit 110, an inner housing unit 120, an outer housing unit 130, an intermediate housing unit 140, and a driving gear train 150. The inner housing unit 120, the outer housing unit 130, and the intermediate housing unit 140 constitute a compressing apparatus housing H.

The compressing apparatus 100 according to the exemplary embodiment performs multistage compression. However, the exemplary embodiments are not limited thereto. For example, the compressing apparatus 100 according to the exemplary embodiment may also include a single impeller unit 110 to have a single compression stage.

The impeller unit 110 is a centrifugal impeller and is disposed in the inner housing unit 120. The impeller unit 110 includes a base plate 111, a plurality of blades 112 installed on the base plate 111, and a rotation shaft 113 connected to the base plate 111.

The rotation shaft 113 is connected to a pinion gear 151 of the driving gear train 150 to be transmitted power, which will be described later.

The impeller unit 110 according to the exemplary embodiment is a centrifugal impeller. However, the exemplary embodiments are not limited thereto. For example, the impeller unit 110 is not limited to a centrifugal impeller but may be other types of impellers such as an axial-flow impeller and a mixed-flow impeller.

The inner housing unit 120 houses at least a portion of the impeller unit 110 and may have a hollow cylindrical shape. According the to exemplary embodiment, the inner housing unit 120 may be manufactured by casting or the like.

As illustrated in FIGS. 2, 3, and 4, the inner housing unit 120 includes an inflow portion 121, a body portion 122, a shroud portion 123, a flange portion 124, and a diffuser portion 125.

A fluid flows through the inflow portion 121 and then flows into the impeller unit 110.

The body portion 122 extends from the inflow portion 121, and an inner housing flow path groove **122*a* is formed in the body portion 122. The an inner housing flow path groove 122*a* constitutes a flow path portion S together with the intermediate housing unit 140**.

Also, for material and weight reduction, an empty space E is formed in the body portion 122.

According to the present exemplary embodiment, the empty space E is formed in the body portion 122; however, exemplary embodiments are not limited thereto. For example, an empty space may not be formed in the body portion 122 according to some exemplary embodiments.

The shroud portion 123 extends from the body portion 122 and is disposed at a position facing the blade 112 of the impeller unit 110.

The flange portion 124 is formed on one side of the inner housing unit 120.

As illustrated in FIG. 3, a seal installation groove **124*a* and a mounting hole 124*b* are formed at a portion of the flange portion 124 that faces the outer housing unit 130**.

A seal ring **124*c* is disposed in the seal installation groove 124*a*, and the seal ring 124*c* contacts the outer housing unit 130** to perform a seal operation.

In an assembly process, a bolt B is inserted into the mounting hole **124*b* to perform a fixation to the outer housing unit 130**.

The diffuser portion 125 extends from the shroud portion 123, and a plurality of diffuser vanes are formed therein.

The diffuser portion 125 is installed in the inner housing unit 120 according to the exemplary embodiment, but exemplary embodiments are not limited thereto. That is, according to exemplary embodiments, a diffuser portion 125 may be installed inside an inner housing receiving portion **130*a* of the outer housing unit 130**.

As illustrated in FIG. 1, the outer housing unit 130 includes an upper outer housing 131 and a lower outer housing 132, and a support unit **132*a* is installed under the lower outer housing 132**.

As illustrated in FIGS. 2 and 5, the inner housing receiving portion **130*a* is formed in the outer housing unit 130 to house at least a portion of the inner housing unit 120**.

Also, an outer housing flow path groove **130*b* is formed in the outer housing unit 130, and after the assembly process, the outer housing flow path groove 130*b* constitutes the flow path unit S together with the intermediate housing unit 140**.

The outer housing flow path groove **130*b* is formed in the outer housing unit 130 according to the exemplary embodiment. However, the exemplary embodiment is not limited thereto. For example, the outer housing flow path groove 130*b* may not be formed in the outer housing unit 130. In this case, only the inner housing flow path groove 122*a* and the intermediate housing unit 140** constitute the flow path unit S.

Also, as illustrated in FIG. 3, an installation hole 130*c*_1 is formed in an inner housing installation unit 130*c* (as a portion of the outer housing unit 130) that faces the flange unit 124 of the inner housing unit 120. The flange portion 124 is fixed to the outer housing unit 130 when the bolt B, which has passed through the mounting hole 124*b* of the flange portion 124, passes through the installation hole 130*c*_1 and is fixed by a nut N.

According to the exemplary embodiment, the seal installation groove 124*a* is formed in the flange portion 124 of the inner housing unit 120 and a seal installation groove is not formed in the inner housing installation unit 130*c* of the outer housing unit 130. However, the exemplary embodiment is not limited thereto. For example, according to exemplary embodiments, the seal installation groove may be formed in at least one of the flange portion 124 of the inner housing unit 120 and the inner housing installation unit 130*c* of the outer housing unit 130. For example, the seal installation groove may be formed only in the flange unit 124, may be formed only in the inner housing installation unit 130*c*, or may be formed in both the flange unit 124 and the inner housing installation unit 130*c*.

In addition, a gear train receiving unit 130*d* is formed in the outer housing unit 130. The gear train receiving unit 130*d* is a space in which the driving gear train 150 is disposed to drive the impeller unit 110.

According to the exemplary embodiment, the gear train receiving unit 130*d* is formed in the outer housing unit 130; however, the exemplary embodiment is not limited thereto. For example, according to an exemplary embodiment, the gear train receiving unit 130*d* may not be formed in the outer housing unit 130. In this case, a scroll and a gearbox may be formed separately instead of being formed integrally, so that the outer housing unit 130 may constitute a scroll and the gear train receiving unit 130*d* may be formed in a separate gearbox.

As illustrated in FIG. 2, the intermediate housing unit 140 is disposed between the inner housing unit 120 and the outer housing unit 130.

The intermediate housing unit 140 may be formed of material such as metal or synthetic resin.

As illustrated in FIGS. 6 and 7, the intermediate housing unit 140 includes a first portion 141 and a second portion 142 that are separately manufactured. When the first portion 141 and the second portion 142 are combined together in the assembly process, the intermediate housing unit 140 may have a hollow cylindrical shape.

According to the exemplary embodiment, the first portion 141 and the second portion 142 of the intermediate housing unit 140 are separately manufactured; however, the exemplary embodiment is not limited thereto. For example, in some an exemplary embodiment, the intermediate housing unit 140 may be integrally formed to have a hollow cylindrical shape from the beginning. In this case, in the assembly process, for combination with the inner housing unit 120, a fluid guide unit 140*a* may be formed of a transformable material or may not be formed.

When the intermediate housing unit 140 is disposed between the inner housing unit 120 and the outer housing unit 130, the intermediate housing unit 140 constitutes the flow path unit S together with the inner housing unit 120 and the intermediate housing unit 140 also constitutes the flow path unit S together with the outer housing unit 130, as illustrated in FIG. 2.

Figure 8:
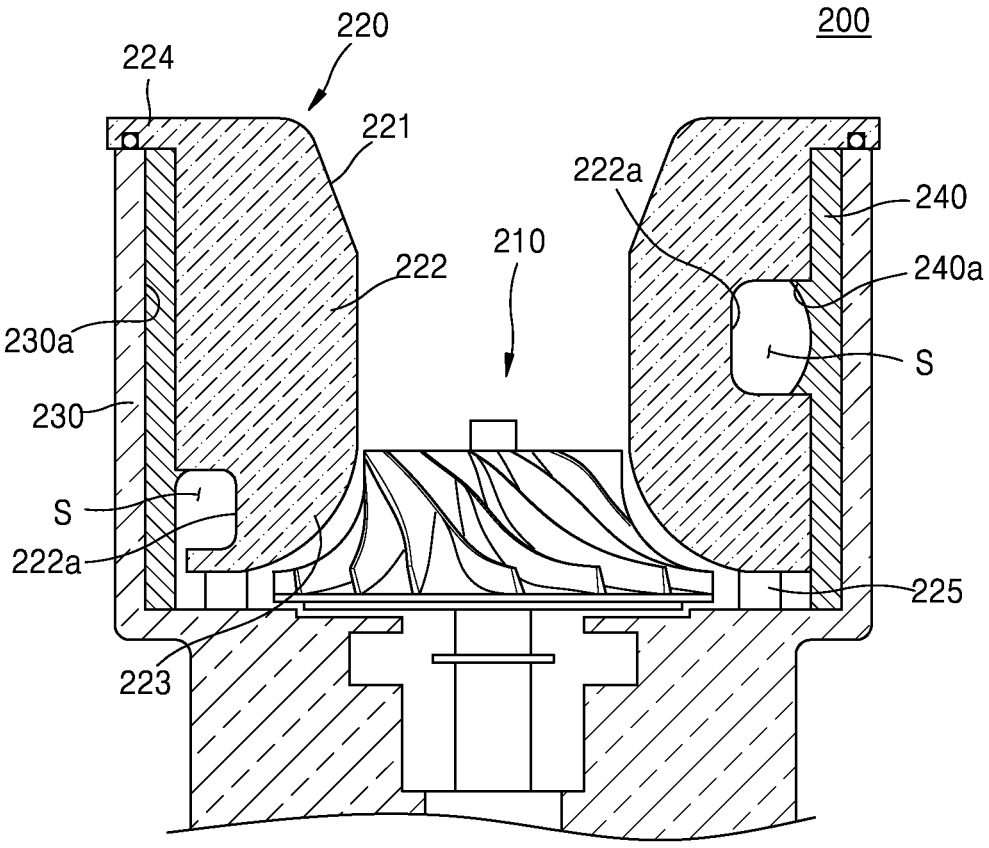
FIG. 8 is a schematic partial cross-sectional view of a compressing apparatus according to a modification of an exemplary embodiment.

According to the exemplary embodiment, the intermediate housing unit 140 constitutes the flow path unit S together with not only the inner housing unit 120 but also the outer housing unit 130. However, the exemplary embodiment is not limited thereto. For example, as illustrated in FIG. 8, according to an exemplary embodiment, an intermediate housing unit 240 may constitute a flow path unit S only together with an internal housing unit 220 without forming a flow path unit with the outer housing unit 130.

As illustrated in FIGS. 6 and 7, a fluid guide unit 140*a* is formed on an outside surface and an inside surface of the intermediate housing unit 140 to guide a fluid flowing through the flow path unit S.

The fluid guide unit 140*a* protrudes from the outside surface of the intermediate housing unit 140. The fluid guide unit 140*a* forms a portion of the flow path unit S and stably guides a fluid flow.

The manufacturer may construct a desired flow path unit S by properly designing the shape, height, and surface roughness of the fluid guide unit 140*a* according to the design intent.

According to the exemplary embodiment, the fluid guide unit 140*a* is formed on both the outside surface and the inside surface of the intermediate housing unit 140; however, the exemplary embodiment is not limited thereto. According to an exemplary embodiment, when the flow path unit S is disposed only on the inside surface or only the outside surface of the intermediate housing unit 140, the fluid guide unit 140*a* may be formed only on one of the surfaces where the flow path unit S is disposed. In some cases, the fluid guide unit 140*a* may not be formed in the intermediate housing unit 140.

Also, a flow hole 140*b* is formed in the intermediate housing unit 140 to connect the flow path unit S to the fluid guide unit 140*a*. That is, because the flow path unit S according to the exemplary embodiment is disposed not only on the inside surface but also on the outside surface of the intermediate housing unit 140, there is a need for the flow hole 140*b* which connects the flow path unit S and the fluid guide unit 140*a* through which a fluid moves.

According to the exemplary embodiment, the flow hole 140*b* is disposed in the intermediate housing unit 140; however, the exemplary embodiment is not limited thereto. According to an exemplary embodiment, when the flow path unit S is disposed only the inside surface or only on the outside surface of the intermediate housing unit 140, the flow hole 140*b* may not be formed.

Referring to FIG. 2, the driving gear train 150 includes a pinion gear 151 connected to the rotation shaft 113, a bull gear 152 connected to the pinion gear 151, and a main driving shaft 153 connected to the bull gear 152.

The driving gear train 150 is disposed in the gear train receiving unit 130*d* of the outer housing unit 130. When the main driving shaft 153 rotates, the resulting power is transmitted through the bull gear 152 and the pinion gear 151 to the rotation shaft 113 of the impeller unit 110 to rotate the impeller unit 110.

The driving gear train 150 according to the exemplary embodiment includes the pinion gear 151, the bull gear 152, and the main driving shaft 153, but the exemplary embodiment is not limited thereto. For example, the driving gear train 150 according to the exemplary embodiment has only to transmit the power to the rotation shaft 113 to rotate the impeller unit 110, and a detailed structure thereof is not limited.

Hereinafter, a method of manufacturing the compressing apparatus 100 according to an exemplary embodiment will be described.

First, the manufacturer prepares the upper outer housing 131 and the lower outer housing 132, in which the inner housing receiving unit 130*a*, the outer housing flow path groove 130*b*, and the gear train receiving unit 130*d* are formed. Also, the manufacturer prepares components of the impeller unit 110, the inner housing unit 120, the intermediate housing unit 140, and the driving gear train 150 to be installed in the compressing apparatus 100.

Subsequently, the manufacturer assembles and disposes the impeller unit 110 and the driving gear train 150 in the inner housing receiving unit 130*a* and the gear train receiving unit 130*d* of the lower outer housing 132, respectively.

The manufacturer assembles the first portion 141 and the second portion 142 of the intermediate housing unit 140 on the outside surface of the inner housing unit 120. As illustrated in FIG. 2, the assemblage is performed such that the fluid guide unit 140*a* of the intermediate housing unit 140 is inserted into a proper position of the inner housing flow path groove 122*a* of the inner housing unit 120.

After forming an assembly by assembling the intermediate housing unit 140 on the inner housing unit 120, the manufacturer inserts the assembly into the inner housing receiving unit 130*a* of the outer housing unit 130.

Thereafter, the manufacturer connects and fixes the upper outer housing 131 to the lower outer housing 132. Herein, the upper outer housing 131 may be fixed to the lower outer housing 132 by screw coupling or by welding. In the fixing process, the manufacturer performs sealing by disposing the seal ring 124*c* in the seal installation groove 124*a* of the inner housing unit 120, and also performs sealing by disposing a seal member such as a seal ring (not illustrated) between the upper outer housing 131 and the lower outer housing 132.

Also, the manufacturer fixes the flange unit 124 of the inner housing unit 120 and the inner housing installation unit 130*c* of the outer housing unit 130 to each other to fix the inner housing unit 120 to the outer housing unit 130. That is, the manufacturer sequentially passes the bolt B through the mounting hole 124*b* of the flange unit 124 and the installation hole 130*c*_1 of the inner housing installation unit 130*c* and then connects the nut N thereto to fix the inner housing unit 120 to the outer housing unit 130.

Hereinafter, a process of operating the compressing apparatus 100 according to an exemplary embodiment will be described.

When the user starts to operate the compressing apparatus 100, the main driving shaft 153 rotates. When the main driving shaft 153 rotates, the bull gear 152 rotates and the pinion gear 151 engaged with the bull gear 152 also rotates.

When the pinion gear 151 rotates, the rotation shaft 113 rotates and the impeller unit 110 also rotates to perform a compression operation.

The pressure of a fluid, which has flowed into through the inflow unit 121 of the compressing apparatus 100, is increased sequentially through the blade 112 of the impeller unit 110, the diffuser unit 125, and the flow path unit S, and the compressed fluid again flows into a next-stage impeller unit or is discharged through an outlet (not illustrated) of the compressing apparatus 100 in the case of a single-stage configuration or a final-stage configuration.

As described above, the compressing apparatus housing H of the compressing apparatus 100 according to the exemplary embodiment includes the inner housing unit 120, the outer housing unit 130, and the intermediate housing unit 140, and the intermediate housing unit 140 is disposed between the inner housing unit 120 and the outer housing unit 130 to constitute the flow path unit S. Thus, various shapes of the flow path unit S may be easily implemented, and the manufacturing process thereof may be simplified.

That is, the manufacturer may easily manufacture the compressing apparatus housing H having the flow path unit S of a desired shape, by designing the flow path unit S suitable for a desired fluid flow by simulation or experiments and then forming the shape of the fluid guide unit 140*a* of the intermediate housing unit 140 to be suitable for the shape of the flow path unit S. In particular, because the flow path unit S of various sizes and shapes may be easily implemented by simply changing only the shape of the fluid guide unit 140*a* of the intermediate housing unit 140, the compressing apparatus 100 of various performances may be manufactured at low cost. That is, because it is not necessary to perform a design modification on all scrolls in order to change the shape of the flow path unit S, various demands of the user on the compressing apparatus 100 may be satisfied at low cost.

In particular, because the manufacturer may apply the inner housing unit 120 of a single size to the outer housing units 130 of various sizes by simply adjusting the size and thickness of the intermediate housing unit 140, the manufacturing cost may be reduced by reducing the number of types of the inner housing unit 120. Because the inner housing unit 120 has a complex structure, the total manufacturing cost may be reduced by reducing the number of types of the inner housing unit 120 while increasing the number of types of the intermediate housing unit 140 that has a relatively simple structure.

Also, according to the exemplary embodiment, the manufacturing cost may be reduced by reducing the number of manufacturing processes and the number of components by simplifying the layout of the internal space of the compressing apparatus 100. Also, because the internal space of the compressing apparatus 100 may be efficiently disposed in a designing process thereof, the volume of the compressing apparatus 100 may be reduced and the convenience of operations for the assembly process or the maintenance process may be improved.

Hereinafter, a compressing apparatus 200 according to an exemplary embodiment will be described with reference to FIG. 8. Herein, differences from the compressing apparatus 100 described above will be described below.

FIG. 8 is a schematic partial cross-sectional view of a compressing apparatus 200 according to an exemplary embodiment.

The empty space E of the above exemplary embodiment as shown in FIG. 2 is not formed in a body unit 222 of the inner housing unit 220 included in the compressing apparatus 200.

Also, the outer housing flow path groove 130*b* of the above exemplary embodiment as shown in FIG. 2 is not formed in an outer housing unit 230. Accordingly, a fluid guide unit 240*a* of the intermediate housing unit 240 is formed along the inside surface of the intermediate housing unit 240, and a flow path unit S is constituted by an inner housing flow path groove 222*a* and the intermediate housing unit 240.

An impeller unit 210, an inflow unit 221, a shroud unit 223, a flange unit 224, and a diffuser unit 225 illustrated in FIG. 8 are substantially identical to the impeller unit 110, the inflow unit 121, the shroud unit 123, the flange unit 124, and the diffuser unit 125 described above.

In the structure of the compressing apparatus 200 according to an exemplary embodiment, because the outside surface of the intermediate housing unit 240 may be smoothly formed, the convenience of assemblage may be improved. For example, in an assembly process, an assembly of the intermediate housing unit 240 and the inner housing unit 220 may be inserted into an inner housing receiving unit 230*a* of the outer housing unit 230 after the outer housing unit 230 is completely assembled.

Because the configurations, operations, and effects other than the above-described configurations, operations, and effects of the compressing apparatus 200 according to an exemplary embodiment are identical to the configurations, operations, and effects of the compressing apparatus 100 according to the above exemplary embodiment described with respect to FIGS. 1-7, redundant descriptions thereof will be omitted herein.

As described above, according to the above-described exemplary embodiments, the compressing apparatus housings and the compressing apparatuses make it possible to easily implement the shape of the flow path unit and reduce the manufacturing costs thereof.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While exemplary embodiments have been particularly shown and described above, it will be understood by those of ordinary skill in the art that various changes in form and details may be made therein without departing from the spirit and scope of the inventive concept as defined by the following claims.

What is claimed is:

1. A compressing apparatus housing comprising:

an inner housing unit configured to house at least a portion of an impeller unit;

an outer housing unit comprising an inner housing receiving unit configured to house at least a portion of the inner housing unit; and an intermediate housing unit provided between the inner housing unit and the outer housing unit, wherein an inner housing flow path groove is formed in an outside surface of the inner housing unit and a first flow path is formed between the inner housing flow path groove and an inside surface of the intermediate housing unit, the inner housing flow path groove extending helically along an axial direction of the inner housing unit, and wherein the outside surface of the inner housing unit including the inner housing flow path groove contacts the inside surface of the intermediate housing unit along an outer circumference of the inner housing unit.

2. The compressing apparatus housing of claim 1, wherein the inner housing unit comprises a flange unit configured to be attached to the outer housing unit.

3. The compressing apparatus housing of claim 2, wherein the flange unit comprises a seal installation groove provided at a portion thereof facing the outer housing unit.

4. The compressing apparatus housing of claim 1, wherein an outer housing flow path groove is formed in an inside surface of the outer housing unit and a second flow path is formed between the outer housing flow path groove and an outside surface of the intermediate housing unit.

5. The compressing apparatus housing of claim 4, wherein the intermediate housing unit comprises a flow hole configured to connect the first flow path and the second flow path.

6. The compressing apparatus housing of claim 1, wherein the outer housing unit comprises:

an upper outer housing; and a lower outer housing connected to the upper outer housing.

7. The compressing apparatus housing of claim 1, wherein the intermediate housing unit has a hollow cylindrical shape.

8. The compressing apparatus housing of claim 1, wherein the intermediate housing unit comprises a fluid guide unit configured to guide a fluid flowing through the first flow path.

9. A compressing apparatus comprising:

at least one impeller unit;

an inner housing unit configured to house at least a portion of the at least one impeller unit;

an outer housing unit comprising an inner housing receiving unit configured to house at least a portion of the inner housing unit; and an intermediate housing unit provided between the inner housing unit and the outer housing unit, wherein an inner housing flow path groove is formed in an outside surface of the inner housing unit and a first flow path is formed between the inner housing flow path groove and an inside surface of the intermediate housing unit, and wherein a centerline of the inner housing flow path groove extends along a helical line on the inner housing unit, the helical line extending spirally in an axial direction of the compressing apparatus.

10. The compressing apparatus of claim 9, wherein the inner housing unit comprises a flange unit configured to be attached to the outer housing unit.

11. The compressing apparatus of claim 10, wherein the flange unit comprises a seal installation groove provided at a portion thereof facing the outer housing unit.

12. The compressing apparatus of claim 9, wherein an outer housing flow path groove is formed in an inside surface of the outer housing unit and a second flow path is formed between the outer housing flow path groove and an outside surface of the intermediate housing unit.

13. The compressing apparatus of claim 12, wherein the intermediate housing unit comprises a flow hole configured to connect the first flow path and the second flow path.

14. The compressing apparatus of claim 9, wherein the outer housing unit comprises:

an upper outer housing; and a lower outer housing connected to the upper outer housing.

15. The compressing apparatus of claim 9, wherein the intermediate housing unit has a hollow cylindrical shape.

16. The compressing apparatus of claim 9, wherein the intermediate housing unit comprises a fluid guide unit configured to guide a fluid flowing through the first flow path.

17. The compressing apparatus of claim 9, further comprising a driving gear train configured to drive the impeller unit, wherein the outer housing unit further comprises a gear train receiving unit configured to house the driving gear train.

* * * * *